US006968691B1

(12) United States Patent
Smith

(10) Patent No.: US 6,968,691 B1
(45) Date of Patent: Nov. 29, 2005

(54) RECIRCULATING MEDIUM TURBINE

(76) Inventor: Robert Samuel Smith, 1263 Emory St., San Jose, CA (US) 95126

( * ) Notice: Subject to any disclaimer, the term of this patent is extended or adjusted under 35 U.S.C. 154(b) by 0 days.

(21) Appl. No.: 09/698,929

(22) Filed: Oct. 26, 2000

(51) Int. Cl.[7] ..... F01K 25/00
(52) U.S. Cl. ..... 60/671; 60/651
(58) Field of Search ..... 60/645, 651, 647, 60/671

(56) References Cited

U.S. PATENT DOCUMENTS 4,438,638 A * 3/1984 Hays et al. ..... 60/671 X
4,760,705 A * 8/1988 Yogev et al. ..... 60/671 X
4,788,824 A * 12/1988 Spurr et al. ..... 60/671

* cited by examiner

*Primary Examiner*—Hoang Nguyen
(74) *Attorney, Agent, or Firm*—Robert Samuel Smith

(57) ABSTRACT

A turbine system including a turbine and a reservoir for working fluid and a turbine. the reservoir is closed so that the workng fluid is heatable up to the critical temperature of the working fluid. An exit pump pumps superheated working fluid from the reservoir onto the impellers in the turbine. An entry pump pumps working fluid from the turbine back to the reservoir. The reservoir is closed (gas tight) permitting heating the working fluid in the reservoir up to the crtical temperature and criical pressure of the working fluid. The exit and entry pumps are coupled together and arrnged such that the rate at which flid enters the reservoir equals the rate that the working fluid leaves the reservoir. By raising the working fluid to in the reservoir in the liquid stae, loss of energy of vaporization is substantially aboided. By maintaining equal rates of charrge and discharge of fluid into and out of the reservoir, loss of energy due to compresion is avoided.

7 Claims, 2 Drawing Sheets

RECIRCULATING MEDIUM TURBINE

FIELD OF THE INVENTION

This invention relates to turbines and particularly to a turbine in which the liquid medium is partially converted to vapor which propels liquid against a vaneless turbine.

BACKGROUND AND INFORMATION DISCLOSURE

Turbines, defined to be a system where the momentum of fluid stream is directed against rotatably mounted vanes, have been in existence for thousands of years in one form or another.

In modern form, a turbine typically includes a combustion chamber for generating a high pressure volume of gas, a nozzle having a converging-diverging channel which shape converts the energy of a gas stream emerging from the combustion chamber from having a large potential component, (large pressure) to having a large kinetic component and a rotating vane section against which the high velocity stream is directed to transfer the kinetic energy of the gas to the rotational energy of the blades. The increase in the kinetic component (increased velocity of the gas stream) is accomplished in the nozzle by passing the gas from an entry section having a large sectional area through a convergent area having a smaller sectional area.

When effectively most all of the conversion from potential to kinetic energy takes place in one "stage",(i.e., one rotating wheel energized by one nozzle,) the turbine is said to operate by "impulse" and the turbine is therefore known as an impulse turbine.

A limit to efficiency of an impulse turbine is imposed by a property of the gas media when a certain "critical pressure", drop across the nozzle is exceeded, then the volume of discharge of gas through the nozzle is constant in spite of increasing ratio of inlet pressure to outlet pressure. Consequently, there is an inherent limit to the amount of energy that can be extracted from the flow of the gas through a nozzle that converts potential to kinetic energy.

In order to overcome this natural limitation, the "reactive" turbine has been developed which includes a gang of nozzle-turbine stages all operating in series. With each stage, the gas stream is subject to a succession of potential to kinetic changes accompanied by successive reduction of energy of the stream so as to extract a maximum total energy from the gas stream before discharging the gas stream to the environment.

Each stage of the reactive turbine includes a stationary section which functions as a nozzle in converting pressure to velocity and a rotating section which converts some of the kinetic energy of the gas stream to kinetic energy of the respective rotating section.

The reactive turbine inherently has a limited efficiency due to losses of energy arising from turbulence of the high speed stream passing through the rotating section and frictional losses of the gas stream passing across the walls of the "stationary" section. The loss of energy due to friction with stationary surfaces increases with the number of stationary sections.

The typical rotating section of the turbine includes blades against which surfaces the gas stream is directed causing the wheel to which the blades are attached to rotate. If a gas molecule, travelling at high speed with a velocity component parallel to the blade surface, could be somehow made to "stick" to the blade surface, then all of the kinetic energy would be transferred to the rotating blade. However, since the molecule does not "stick" to the blade surface, it leaves only part of its kinetic energy and consequently, turbine systems are designed with a number of stages for successively absorbing the energy of the stream. These constructions are expensive. Another characteristic of turbine systems is that very large velocities of the gas stream are required to transport a useful rate of power because of the low density of the gas stream. Consequently, the turbines are characterized by much larger rotational velocities than with other types of engines such as the internal combustion engines. Furthermore, the high velocities go hand in hand with a requirement for higher operating temperatures which generally requires the use of more expensive materials and designs in which heat dissipation is an important consideration.

In order to avoid many of these problems, particularly complexity of design, the "vaneless" turbine was introduced around the beginning of the twentieth century. The vaneless turbine is simply a stack of disks rotatably mounted and closely spaced from one another on a common axis in which a gas stream from a nozzle is directed generally tangentially in the space between the disks. The frictional drag of the stream of gas across the surfaces of the disks causes the disks to rotate. In contrast to the impulse type of turbine having blades, the greater the frictional force of the gas stream against the disk surfaces, the greater will be the rate of transfer of kinetic energy from the gas stream to the rotating disk and, hence, the greater will be the efficiency of the turbine. In fact, the limitation of efficiency of the disk turbine is the limitation of the magnitude of friction between the gas stream and the disk surface and the length of the path. Another inherent limitation is the low density of the gas stream requiring that fast velocities (implying large temperature of the gas stream) is required for effective energy carrying capacity.

In summary, the efficiency of the typical impulse turbine is limited by the amount of work required to compress the gas for entry into the compression chamber and by the energy losses due to friction of the gas passing through the nozzle and turbulence of the gas passing through the rotating section. The efficiency of the typical vaneless type of turbine system is limited by the energy required to compress the gas prior to in a combustion chamber, the limit on the frictional interaction between the gas stream and the walls of the disk coupled with the limited path length of the gas stream across the disk surfaces before discharge of the gas stream to the environment.

For the purposes of this specification, it is useful to review the action of the steam cleaner which is well known in the market place. the steam cleaner includes a reservoir of water, a heater for heating the water and a nozzle that directs combination of steam and water droplets against a surface to be cleaned. The device uses steam expansion to propel water droplets at near the boiling temperature of water at a considerable velocity.

In the typical steam cleaner, water is heated to 325° F. in a pressure range between 90 to 250 psi. Water heated to 325 degrees remains liquid at any pressure over 80 psi. (the saturated pressure of steam at that temperature. When water that is pressurized greater than 80 psi and heated to 325° F. passes through the nozzle thereby suddenly reducing the pressure, the water is suddenly cooled to 212° F. by vaporizing a portion of its volume (5 to 15%) to steam. The steam vapor, formed in an appropriately designed nozzle including an expansion nozzle placed past the pressure orifice, propels and directs the water as droplets from the mouth of the nozzle.

When water vaporizes, it expands to 27 times its former volume. This expansion is directed by the conical steam nozzle so that the nozzle serves as a propulsion chamber. The expansion nozzle both creates an explosive effect and directs the energized water droplets.

There are two types of steam cleaners: "vapor" cleaners and "hydraulic pressure combination"cleaners (HPC).

The vapor cleaner relies almost entirely on vaporization in the expansion nozzle for propulsion of the cleaning solution. The pump generally produces only enough pressure (about 80 psi) against the solution to keep it from boiling. in the coil.

The HPC cleaner operates in the range 150 to 250 psi. At this greater pressure, a smaller fraction of water "flashes" to steam but the higher pressure adds the additional energy to the water droplets. Typically, 5 to 7% water flashes to steam in a HPC cleaner. The size of the water droplets decreases as the size of the pressure orifice on the nozzle is decreased. The larger water droplets create more impact on the surface being impinged by the water.

SUMMARY OF THE INVENTION

It is an object of this invention to overcome disadvantages of the turbine with vanes in which losses are introduced by the requirement to compress the gas entering the combustion chamber, by frictional losses of the gas passing over the stationary surfaces of the nozzle section, and by the limitation not to exceed the critical pressure drop across the turbine blades. It is a further objective to overcome the limitations of the vaneless turbine caused by slippage at the boundary layer between the gas stream and the surface of the disks thereby reducing the amount of kinetic energy that can be transferred from the stream to the disks for a fixed length of path of the stream over the disk surfaces.

This invention is directed toward a stack of disks spaced close to one another on a rotatable shaft (a vaneless turbine) in which the high velocity media directed tangentially through the spaces between the disks is a stream of high velocity liquid droplets propelled according to the principles of the steam cleaner.

In the general case, the working fluid is a liquid having a boiling temperature at atmospheric pressure that is close to the temperature of te environment.

The small amount of liquid that is converted to gas (about 5%) passes from the space between the disks through an exit being an opening in the tubular shaft that permits the gas to pass through the shaft and be recirculated back through the system. The propelled liquid droplets are collected on the surface of the disks so that all of the kinetic energy is converted to kinetic energy of the rotating disks. As liquid is condensed on the disk surfaces, it flows by centrifugal force to the rim of the respective disk where it forms a pool of liquid that rotates with the disks until it exits through an exit port at the periphery of the disks. The exit port at the periphery of the disk directs the liquid through a special valve of this invention back to the reservoir for recirculation. Pressure of the returning liquid generated by the centrifugal force of the pool of liquid at the rim of the disks aids in returning the energy depleted liquid through the special valve from the stack of disks back to the reservoir.

According to the special valve embodiment, the work generated by admitting a volume of liquid from the reservoir at high pressure to the expansion nozzle at low pressure is used to force the same volume of energy depleted liquid from the turbine housing to the reservoir.

The amount of energy supplied to the system is equal to the thermal energy generated by the burning fuel which heats the liquid in the reservoir. The useful energy produced by the system equals work supplied by the rotating shaft of the turbine. The energy dissipated by the system is determined by:

1. the heat of condensation of the liquid being about 5% of the total liquid current ejected into the turbine. This energy loss can be minimized according to the efficiency of the design to circulate the energy of condensation back into the system.

2. the frictional energy of the stream of liquid constituting the boundary layer at the interface of the outer housing and the liquid. This surface area is very small compared to the surface of the disks.

3. the efficiency of design in using as large a fraction as possible of the heat of burning the fuel for heating the liquid. This can be increased, for example, by warming the air supplied to burn the fuel using the heat of condensation of the fuel.

BRIEF DESCRIPTION OF THE DRAWINGS

Turning now to a discussion of the drawings, FIG. 1 shows a mechanical schematic of the invention including a turbine 11 being a rotatably mounted stack of closely spaced disks 10 enclosed in a housing 12. In FIG. 1, the housing 12 is partially cutaway to show the disks 10. The droplets of liquid working fluid and gas S (vaporized working fluid) is directed through a nozzle 14 tangentially into the space between the disks 10 thereby turning the disks 10. As the vaporized working medium condenses on the surfaces of the disks, it flows toward the periphery of the disks (by centrifugal force) and is guided by the housing 12 to flow out of exit port 16 as liquid. The liquid W flows through conduit 18 to reservoir 17 where it is reheated and returned to the nozzle 14. A pump 20 is shown connected to the conduit 18 near the entry port and another pump 22 is shown connected to the conduit near the nozzle. Fluid flows into reservoir 17 where is heated by heat source 24. The pumps serve the function of controlling the flow of liquid through the conduit 18 and isolate the conduit 18 from the nozzle 14 and turbine 10 so that required critical pressure is generated in the reservoir 17 by heat while the pressure in the turbine acquires a value corresponing to the liquid at the tempoerature of the surrounding environment. Not shown are pumps 20, 22 coupled to the turbine shaft. and to one another so that the amount of working fluid forced into the high pressure region by one pump is released from the high pressure region by the other pump.

Entry pump 20 at the entry end of the turbine requires "pump" energy to deliver a given volume of liquid W (condensed vapor) from the turbine environment (where the temperature of the working fluid is ambient and the vapor pressure of the liquid corresponds to the ambient temperature) to the conduit 18. The "pump" energy required to drive pump 20 is derived from fluid forcing pump 22. Pump 22 ideally generates an equal amount of energy to deliver an equal amount of liquid from the conduit 18 (where pressure is high) to the turbine where pressure is ambient. Since both pumps are coupled to one another through the turbine shaft, under ideal conditions, there is no energy required to operate the combination of pumps. This is an advantage over the typical gas driven turbine where work is required to compress the gas entering a combusiton chamber.

Figure 1:
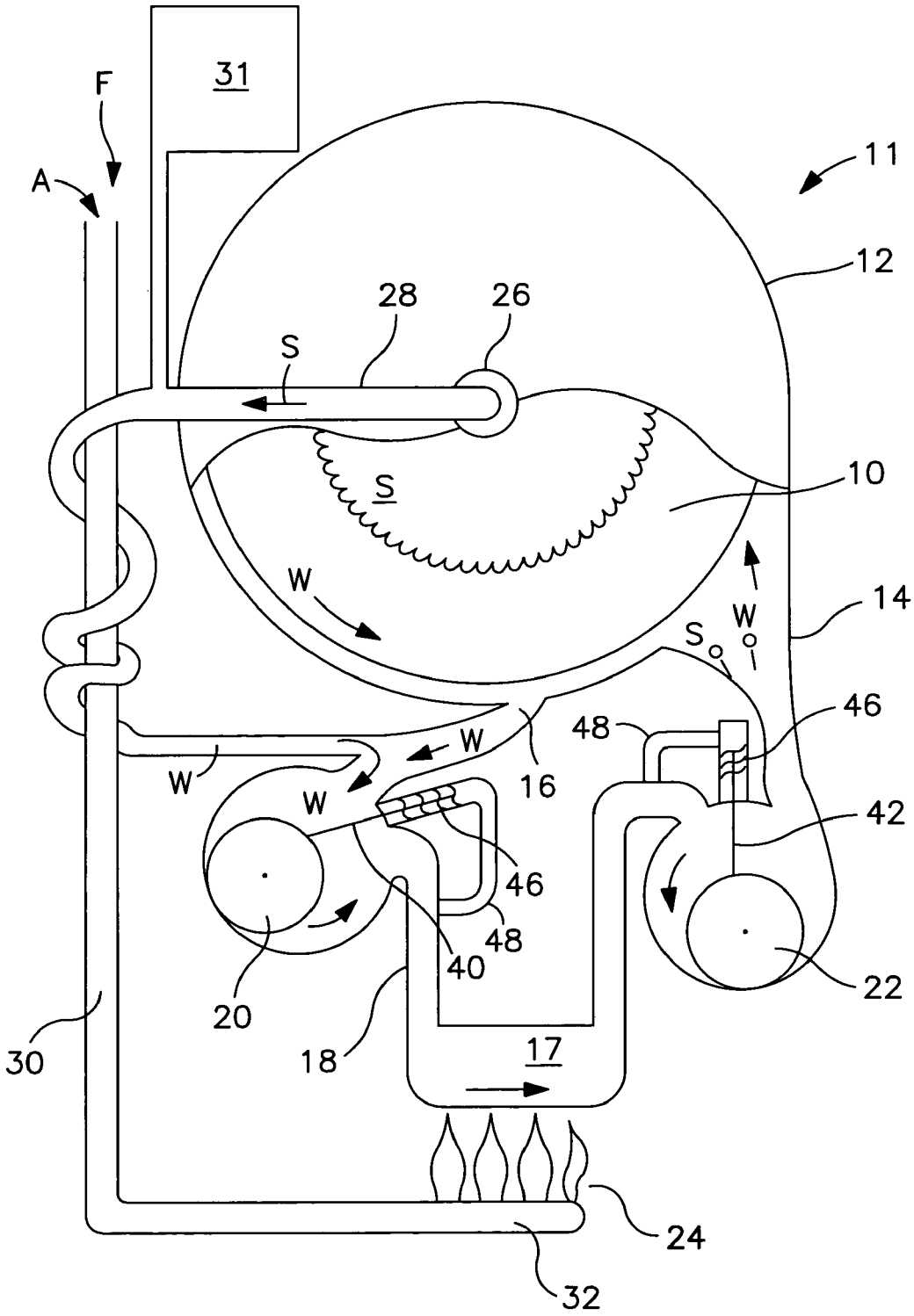
FIG. 1 shows a schematic of the invention.
Figure 2A:
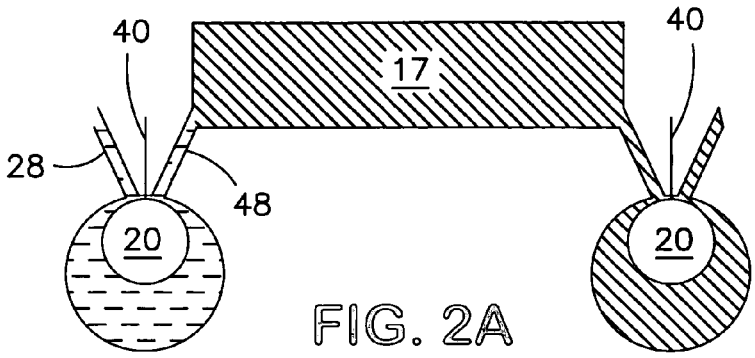
FIG. 2 shows the action of two rotary punps coupled togerther. (coupling not shown)
Figure 2B:
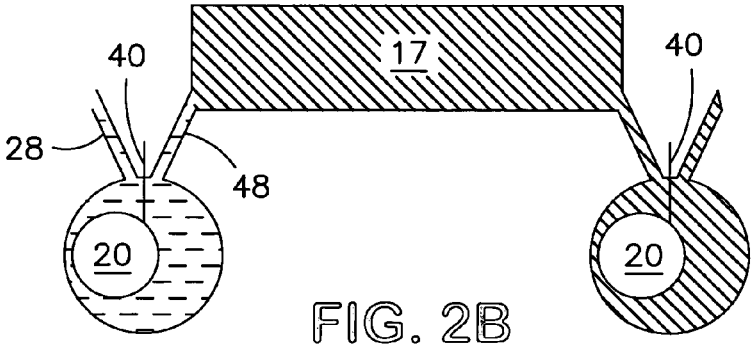
Figure 2C:
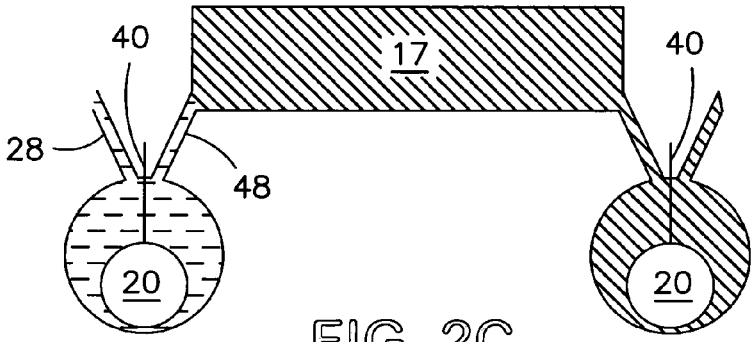
Figure 2D:
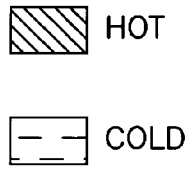
Figure 2D:
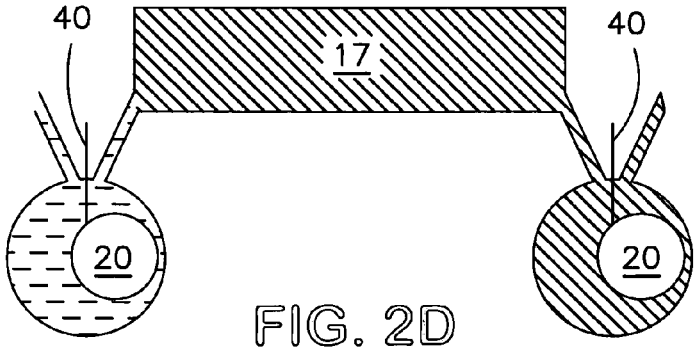

In the event the that there is not one-to-one correspondence between the energy required by pump 20 and the energy delivered by pump 22, then turbine 10 is coupled to pump 20 (coupling not shown in FIG. 1) and the turbine 10 is "cranked" in order to start the turbine rotating.

The liquid at critical pressure that is ejected from the from the nozzle flashes to a mixture of gas (about 5%) and liquid droplets. The more dense liquid W and a major portion of condensed vapor S collecting on the disks flows away from the turbine shaft 26. The vaporized working fluid, that has remained evaporated, is directed toward the turbine shaft 26 where it escapes through openings (not shown) in the shaft out of the end of shaft 26 and through a conduit 28. Conduit 28 is in thermal contact with air-fuel supply conduit 30 thereby warming the air and fuel before the fuel is burned at burners 32 to heat the working fluid in conduit 18. The prewarming of the air and fuel in conduit 18 effects an additional energy serving in terms of increasing the heat of combusition of the fuel and further effects condensation of any remaining vapor.

The turbine is turned by the jet of the liquid droplets impinging and collecting on the disk surfaces as discussed above. The effect of slippage that characterizes state of the art vaneless turbines propelled by a gas stream is avoided. The problem imposed by the phenomenon of "critcal pressure" that characterizes impulse and reactive turbines having vanes is avoided.

FIGS. 2A–D illustrate the action of tworotarty pumps 20. 22 illustrating constant volume of heated working fluid as it is pumped through the reservoir.

Various fluids may be used to drive the turbines. These may include ammonia or freon which would provide the means to operate at a lower temperature.

A particular advantage in improved efficiency is gained by selecting a fluid having a boiling temperature that is a little above room temperature and operating the system between between boiling temperature and the critical temperature. The critical temperature is the temperature at which no energy (heat flow) is required to convert the medium from the liquid state to the gaseous state. Therefore, all of the enrgy of expansion from liquid to gas is converted to kinetic energy of the remaining liquid phase. The liquid phase will continue to boil off liquid until its temperature drops down to the boiling temperature which will be the temperature of the vanes and housing. But since this lower temperature is close (a little above) to the temperature of the environment, there will be only negligible loss of thermal energy to the enviornment so that the net loss of energy either due to phase change or conduction of heat to the environment is minimized.

An alternative approach is to have a closed system (i.e., closed turbine housing) and select a woring liquid whose boiling temperature is below ambient temperature. Under this condition, the lower pressure of the working fluid will depend on the temperature of the environment and there will be no heat flow from the working fluid to the environment. The temperature of the fluid impinging on the disks will depend on the length of the discharge tube directed at the disks and the rate at which liquid is delivered to the discharge tube.

The following table lists fluids which have a boiling temperature a little above the environment and a critical temperature within a practical range for operting the invention:

| | boiling T ° C. | critical T ° C. | critical P (atm) |
|---|---|---|---|
| carbon disulfide | 46.25 | 273 | 75 |
| Pentane | 36 | 196 | 3.64 $P/mP_a$ |

The conduit line 28 communicates with a reservoir 31 to store liquid under pressure for the purpose of permitting adjustment of operatng conditions. In this version, if a working fluid is selected having a boiling temperature (at one atm) that is below the temperature of the environment, then the pressure in the turbine housing will rise to a value where the temperature of the condensate equals the temperature of the environment. and there will be no loss of energy due to heat flow to the environment.

Under ideal conditions of construction and operation of the system, where there is no extraneous heat loss as characterizes state of the art turbines and internal combusition engines, and the only enregy delivered by the system is through the turbine shaft, the present invention is a very efficient engine.

In summary, advantages of the recirculating turbine of this nvention are listed as follows:

1. No energy of compression is required. 95% of the working fluid remains liquid throughout the entire cycle.

2. No loss of heat occurs at the low temperature end of the cycle because the temperature at the low end of the cycle is close to room temperature.

3. The high temperature end of the cycle (the boiler) is at the critical temperature so that no loss of heat is involved due to latent heat of vaporization.

4. The energy difference between the boiler temperature (critical temperature) goes mostly into kinetic energy of the working fluid. Only 5% of the working fluid is converted to vapor so that there is negligible requirement to give up a large amount of latent heat.

5. A wide range of options is provided for selecting a fuel for heating the working fluid.

Variations and modifications of the invention may be contemplated after reading the specification and studying the drawings that are within the scope of the invnetion.

For example, the principles of the invention apply to any one of a number of design of the turbine. In the embodiment discusssed above, the turbine included a stack of disks mounted on a rotatable shaft. Another version is a turbine consisting of paddles mounted on the rotatable shaft. In the context of this specification, a turbine will be understood to mean a rotatable shaft having any one of impeller members (paddles, or disks) mounted on the shaft arranged to catch a stream of working fluid direced against the paddles or disks. A turbine system will be understood to include a turbine, a working fluid means for heating the working fluid by a heat source, and the plumbing associated with directing the working fluid against impeller members of the turbine.

I therefore wish to define the scope of my invention by the appended claims.

I claim:

1. A turbine system comprising:

a housing;

impeller member mounted on a rotatable shaft; inside said housing;

a reservoir means for holding a working fluid;

said reservoir means being air tight;

a heating means for heating said reservoir means to an elevated temperature;

exit conduit arranged to conduct working fluid from said reservoir into said housing against said impeller member;

entry conduit for conducting working fluid from said housing into said resrvoir;

exit pump means for pumping working fluid from said reservoir through said exit conduit to said housing;

entry pump means arranged for pumping working fluid from said housing to said reservoir;

said exit pump means coupled to said entry pump means in an operable arrangement to provide that rate at which said entry pump means delivers working fluid from said housing to said reservoir equals rate at which said exit pump delivers working fluid from said reservoir to said housing.

2. The turbine system of claim 1 wherein said elevated temperature is the critical temperature of said working fluid.

3. The turbine system of claim 1 wherein said working fluid is carbon disulfide.

4. The turbine system of claim 1 wherein said working fluid is pentane.

5. The turbine system of claim 1 wherein said impeller member is a stack of disks.

6. The turbine system of claim 1 wherein said housing is exposed to ambient conditions providing that said housing is at a temperatue close to atmospheric temperature and pressure.

7. A turbine system comprising:

a housing;

a stack of disks mounted on a shaft, said shaft being rotatably mounted within said housing;

a quantity working fluid;

a reservoir means for holding said working fluid;

said reservoir means being gas tight;

heating means for heating said working fluid in said reservoir to an elevated temperature of said working fluid;

exit conduit arranged to conduct working fluid from said reservoir into said housing against said impeller member;

entry conduit for conducting said working fluid from said housing into said reservoir exit pump means for pumping working fluid from said reservoir through said exit conduit to said housing;

entry pump means arranged for pumping working fluid from said housing through sid entry conduit to said reservoir;

said exit pump means coupled to said entry pump means in an operable to provide that rate at which said entry pump means delivers working fluid from said housing to said reservoir equals rate at which said exit pump delivers working fluid from said reservoir to said housing.

* * * * *